US010161723B2

(12) United States Patent
Hales et al.

(10) Patent No.: US 10,161,723 B2
(45) Date of Patent: Dec. 25, 2018

(54) CHARGE CASE FRAGMENTATION CONTROL FOR GUN SURVIVAL

(71) Applicant: Halliburton Energy Services, Inc., Houston, TX (US)

(72) Inventors: John H. Hales, Frisco, TX (US); John Burleson, Denton, TX (US); John P. Rodgers, Southlake, TX (US); Timothy S. Glenn, Dracut, MA (US)

(73) Assignee: Halliburton Energy Services, Inc., Houston, TX (US)

( * ) Notice: Subject to any disclaimer, the term of this patent is extended or adjusted under 35 U.S.C. 154(b) by 450 days.

(21) Appl. No.: 14/648,568

(22) PCT Filed: Dec. 19, 2012

(86) PCT No.: PCT/US2012/070575
§ 371 (c)(1),
(2) Date: May 29, 2015

(87) PCT Pub. No.: WO2014/098836
PCT Pub. Date: Jun. 26, 2014

(65) Prior Publication Data

US 2015/0316359 A1 Nov. 5, 2015

(51) Int. Cl.
*E21B 43/117* (2006.01)
*E21B 43/263* (2006.01)
(Continued)

(52) U.S. Cl.
CPC ..... *F42B 1/02* (2013.01); *E21B 43/117* (2013.01); *E21B 43/263* (2013.01); *F42B 1/036* (2013.01); *F42B 12/24* (2013.01); *F42B 12/32* (2013.01)

(58) Field of Classification Search
CPC .... E21B 43/117; E21B 43/116; E21B 43/263; F42B 12/24; F42B 1/02; F42B 1/036; F42B 12/32
See application file for complete search history.

(56) References Cited

U.S. PATENT DOCUMENTS 3,021,784 A * 2/1962 Meddick ..... E21B 43/117 102/306
6,371,219 B1 4/2002 Collins et al.
(Continued)

OTHER PUBLICATIONS

International Search Report and Written Opinion issued in related PCT Application No. PCT/US2012/070575 dated Aug. 27, 2013, 12 pages.
(Continued)

*Primary Examiner* — Daniel P Stephenson
(74) *Attorney, Agent, or Firm* — Scott Richardson; Baker Botts L.L.P.

(57) ABSTRACT

A method for forming a perforation is disclosed. The method comprises positioning a perforating gun at a desired location in the formation. The perforating gun comprises a gun body and a charge carrier. The method further comprises disposing one or more shaped charges within the charge carrier. The one or more shaped charges comprise an outer case, an inner liner, and an explosive material retained between the outer case and the inner liner. The outer case of the shaped charge comprises one or more predefined fracture lines. The method further comprises detonating at least one shaped charge, wherein detonating the at least one shaped charge forms one or more perforations in the formation.

19 Claims, 4 Drawing Sheets

(51) Int. Cl.

| | |
|---|---|
| ***F42B 1/02*** | (2006.01) |
| ***F42B 1/036*** | (2006.01) |
| ***F42B 12/24*** | (2006.01) |
| ***F42B 12/32*** | (2006.01) |

(56) References Cited

U.S. PATENT DOCUMENTS

| | | | | |
|---|---|---|---|---|
| 6,464,019 | B1 | 10/2002 | Werner et al. | |
| 8,161,884 | B1 | 4/2012 | Kokodis et al. | |
| 2002/0189482 | A1 | 12/2002 | Kneisl et al. | |
| 2008/0034951 | A1* | 2/2008 | Evans | E21B 43/117 89/1.15 |
| 2009/0151949 | A1 | 6/2009 | Maraya et al. | |
| 2011/0056691 | A1* | 3/2011 | King | B22F 3/1258 166/298 |
| 2012/0168162 | A1* | 7/2012 | Sampson | E21B 43/117 166/297 |
| 2013/0118805 | A1* | 5/2013 | Moody-Stuart | E21B 43/116 175/2 |
| 2014/0060369 | A1* | 3/2014 | Mclean | F42B 12/10 102/310 |
| 2015/0316359 | A1* | 11/2015 | Hales | E21B 43/117 175/4.57 |

OTHER PUBLICATIONS

International Preliminary Report on Patentability issued in related PCT Application No. PCT/US2012/070575 dated Apr. 20, 2015, 8 pages.

* cited by examiner

CHARGE CASE FRAGMENTATION CONTROL FOR GUN SURVIVAL

CROSS-REFERENCE TO RELATED APPLICATION

The present application is a U.S. National Stage Application of International Application No. PCT/US2012/070575 filed Dec. 19, 2012, which is incorporated herein by reference in its entirety for all purposes.

BACKGROUND

Subterranean operations are commonly performed to retrieve hydrocarbons from different formations. A well may be drilled into a formation of interest and various operations may be performed to efficiently retrieve hydrocarbons from the subterranean formation. In many cases, a tubular string, such as a casing, a liner, a tubing or the like, is positioned within the wellbore. The tubular string increases the integrity of the wellbore and provides a path through which fluids from the formation may be produced to the surface. To produce fluids into the wellbore or tubular string, perforations may be made through the wellbore and/or tubular string and into the formation.

One method of creating these perforations is through the use of explosives, such as shaped charges. The shaped charges are usually disposed within a charge carrier of a perforating gun. The shaped charges typically include a charge case, a quantity of high explosive, and a liner. In operation, the perforations are made by detonating the high explosive which causes the liner to form a jet of particles and high pressure gas that is ejected from the shaped charge at very high velocity. This jet penetrates the wellbore or tubular string, thereby creating one or more openings extending from the wellbore or tubular string and into the formation. When the shaped charges are detonated, numerous metal fragments are created due to, among other things, the disintegration of the charge cases of the shaped charges. These fragments often fall out or are blown out of the holes created in the charge carrier. As such, these fragments become debris that may be left behind in the wellbore. This debris can obstruct production as well as the passage of tools through the wellbore or tubular string during subsequent operations. This is particularly problematic in long production zones that may be perforated in horizontal wells as the debris simply piles up on the lower side of such wells.

One approach to reducing the debris from the shaped charges is to make the shaped charges from a zinc alloy to reduce the amount of undesirable debris from the system. This is because zinc breaks up into very small particles upon detonation and may also change from a solid phase to a gas phase due to chemical reactions downhole. However, zinc charges also have their disadvantages. For example, the zinc detonation may result in an undesirably large and rapid pressure rise.

It is therefore desirable to design a shaped charge that can achieve the desired charge performance with reduced downhole problems. For instance, it is desirable to reduce debris fragmentation and substantially eliminate the rapid pressure rise often caused by prior art zinc charges.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DETAILED DESCRIPTION OF THE DRAWINGS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

The terms "couple" or "couples" as used herein are intended to mean either an indirect or direct connection. Thus, if a first device couples to a second device, that connection may be through a direct connection, or through an indirect mechanical or electrical connection via other devices and connections.

The present invention relates generally to an apparatus and method for perforating a subterranean wellbore using explosive shaped charges, and more particularly, in certain embodiments, to an apparatus and method of controlling charge case fragmentation for improved perforator gun survival.

Figure 1A:
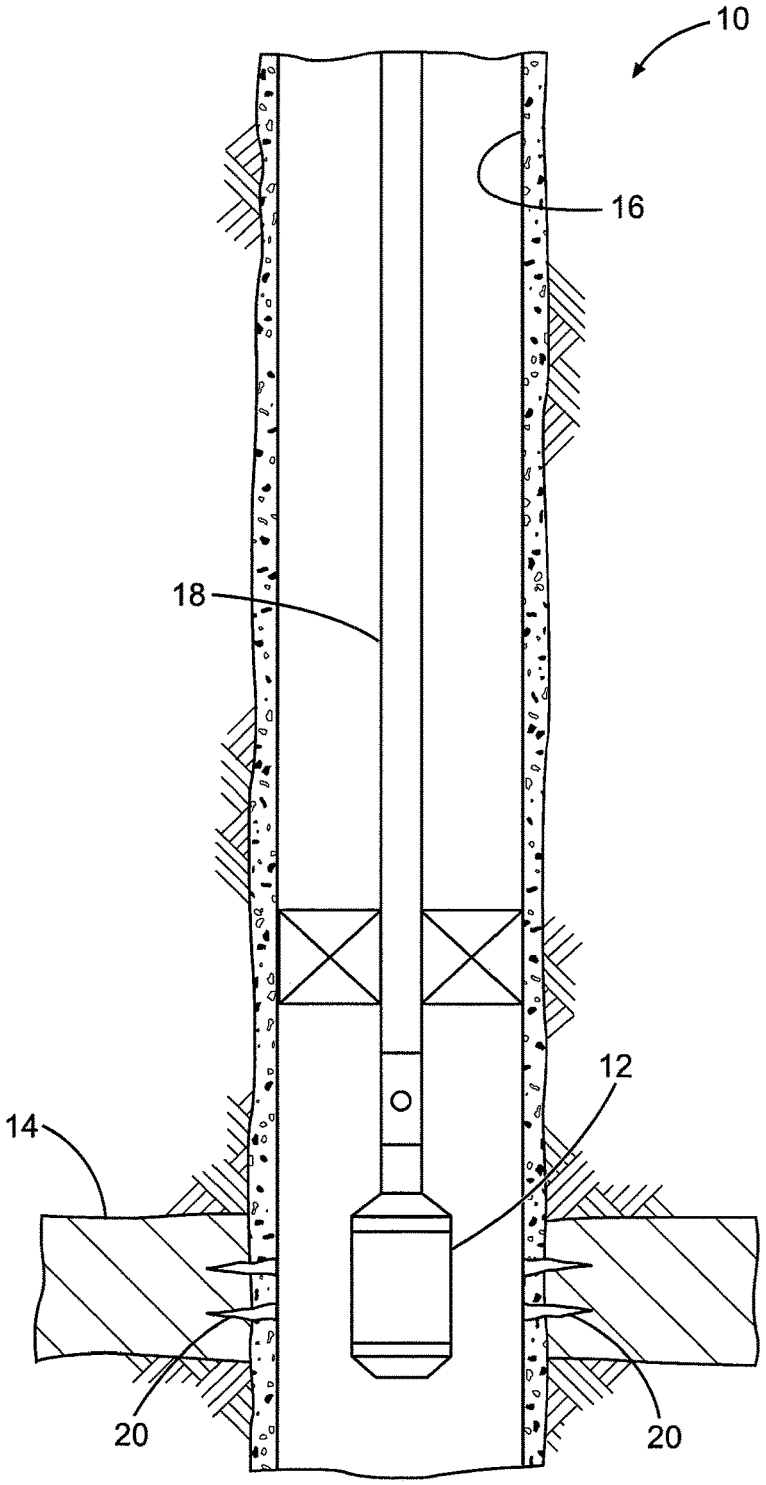
FIG. 1A illustrates a partial cross-sectional view of a perforating gun conveyed into a wellbore in accordance with certain embodiments of the present disclosure.

Referring to FIG. 1A, a system for forming perforations in accordance with an illustrative embodiment of the present disclosure is denoted generally with reference number 10. A perforating gun 12 may be conveyed into a wellbore 16 and positioned at desired location within a formation 14. The perforating gun 12 may be conveyed on a tubular string 18 and may be movable along a wellbore axis from a first position to a second position as desired. The methods and systems for lowering components in the wellbore and moving components along the wellbore axis are well known to those of ordinary skill in the art and will therefore not be discussed in detail herein.

Figure 1B:
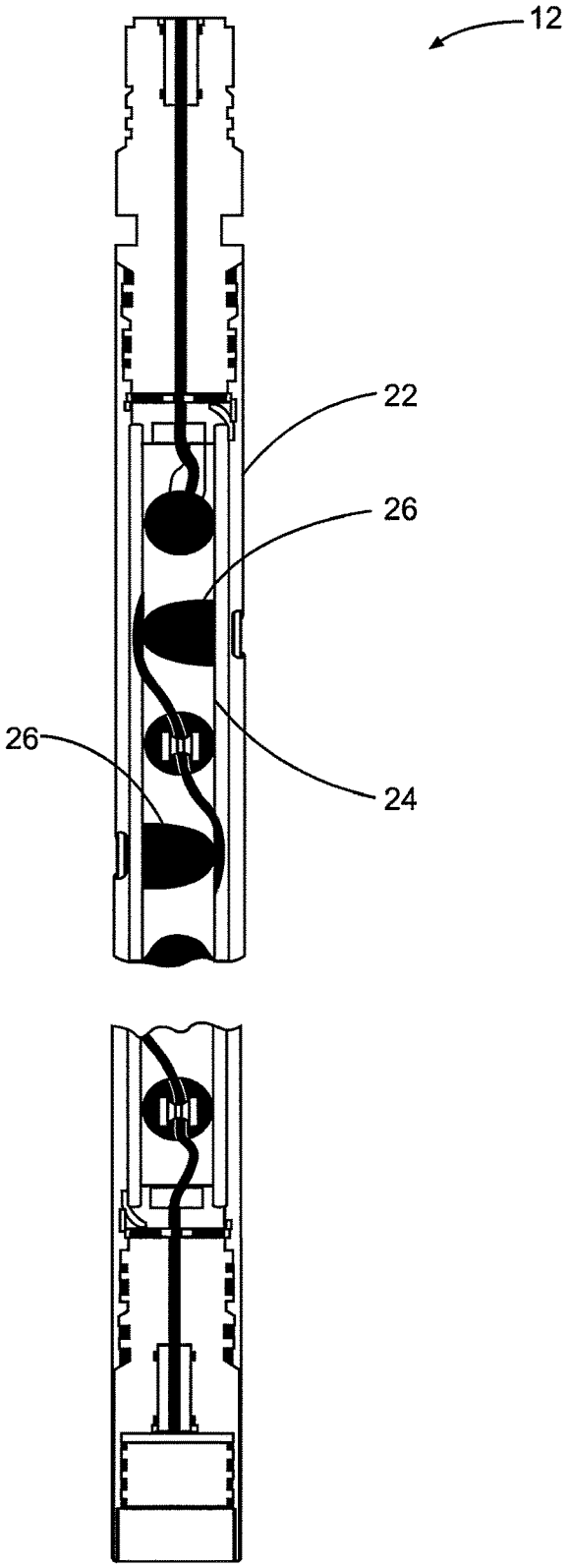
FIG. 1B illustrates a partial cross-sectional view of a perforating gun in accordance with certain embodiments of the present disclosure.

Referring now to FIG. 1B, the perforating gun 12 is shown in more detail. The perforating gun 12 may further include a gun body 22 and a charge carrier 24. In certain embodiments in accordance with the present disclosure, one or more shaped charges 26 may be coupled to the charge carrier 24. In certain implementations, the shaped charges 26 may be disposed within the charge carrier 24.

In an embodiment as illustrated in FIGS. 1A and 1B, the perforating gun 12 may be fired, detonating the shaped charges 26 and forming perforations 20 extending from the wellbore 16 (through the casing, if the wellbore is cased) and into the formation 14. As would be appreciated by those of ordinary skill in the art, having the benefit of the present disclosure, the principles of the present disclosure may be incorporated into a number of different perforating methods. For instance, in another embodiment, the shaped charges 26 may be used in wells to perforate a tubular string or to provide detonation transfer between perforating guns. After detonation, the gun body 22 may include one or more exit holes (not shown). The exit holes (not shown) may be formed by a jet of particles and high pressure gas that is ejected from the shaped charges 26 at a high velocity upon detonation.

Figure 2:
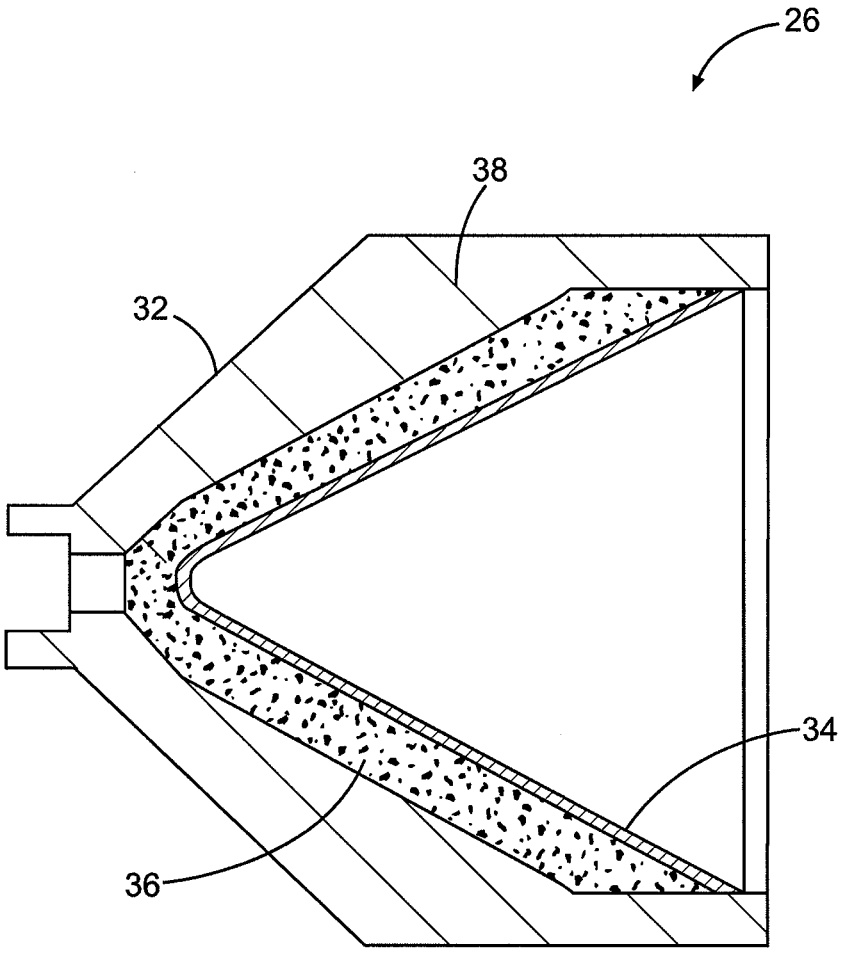
FIG. 2 illustrates a cross-sectional view of a shaped charge, in accordance with a first illustrative embodiment of the present disclosure.

Referring to FIG. 2, one of the shaped charges 26 in accordance with the present disclosure is shown in more detail. The shaped charge 26 may include an outer case 32, an inner liner 34, and an explosive material 36 retained between the outer case 32 and the inner liner 34. In certain embodiments in accordance with the present disclosure, the outer case 32 may comprise one or more predefined fracture lines 38. In certain embodiments in accordance with the present disclosure, the predefined fracture lines 38 may be integrated into the outer case 32, but may not be visible. The outer case 32 may be formed using any suitable manufacturing process. For instance, the outer case 32 may be formed using one or a combination of machining, molding, hot isostatic pressing, brazing, encapsulating, compositing, bonding, forging, sintering and laser depositing. In certain embodiments, the outer case 32 may comprise a metal including, but not limited to, aluminum alloy, steel alloy, copper alloy, zinc alloy, nickel alloy, tungsten alloy, or a combination thereof. In other embodiments, the outer case 32 may comprise a ceramic. In yet other embodiments, the outer case 32 may comprise a composite. The composite may comprise a ceramic matrix or a metal matrix (discussed below).

Figure 3A:
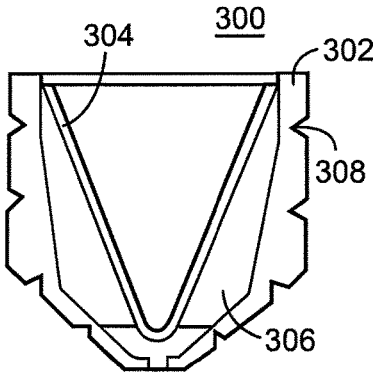
FIG. 3A illustrates a cross-sectional view of a shaped charge, in accordance with a second illustrative embodiment of the present disclosure.
Figure 3B:
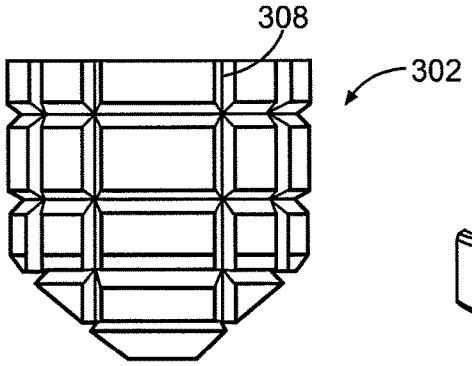
FIG. 3B illustrates a side view of the shaped charge of FIG. 3A.
Figure 3C:
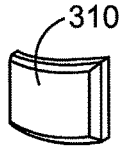
FIG. 3C illustrates a predefined fragment of the shaped charge of FIGS. 3A and 3B.

Referring to FIG. 3A, a shaped charge in accordance with a first illustrative embodiment of the present disclosure is denoted generally with reference numeral 300. The outer case 302 of the shaped charge 300 may be formed from a solid metal and further include one or more grooves 308 in the metal. The grooves 308 may be molded into the solid metal by a material forming process including, but not limited to, molding, forming, pressing or forging, or machined by a material removal process performed after initial forming, including, but not limited to, cutting, chemically etching, laser ablating, or abrasive jet cutting/eroding. FIG. 3B shows a side view of the shape charge 300 of FIG. 3A. As shown in FIG. 3B, the grooves 308 may form one or more stress concentrations or predefined fracture lines on the outer case 302. As would be appreciated by those of ordinary skill in the art having the benefit of this disclosure, upon firing the perforating gun 12, the explosive material 306 of the shaped charges 300 may be detonated. Upon detonation of at least one shaped charge 300, the explosive material 306 may cause the inner liner 304 to form a jet of particles and high pressure gas that is ejected from the shaped charge 300 at a high velocity. Further, upon detonation of at least one shaped charge 300, the outer case 302 of the detonated shaped charge 300 may break apart into one or more predefined fragments 310, as illustrated in FIG. 3C, and defined by the predefined fracture lines 308 of the shaped charge 300. Accordingly, the predefined fracture lines 308 of the outer case 302 may be designed so that upon detonation, the outer case breaks into fragments 310 having a desired shape.

Figure 4A:
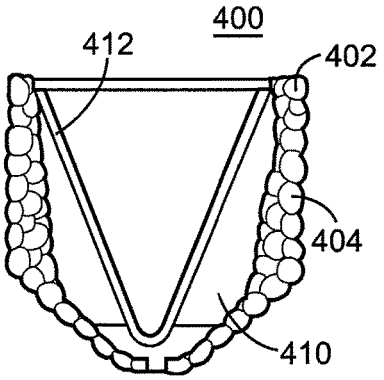
FIG. 4A illustrates a cross-sectional view of a shaped charge, in accordance with a third illustrative embodiment of the present disclosure.
Figure 4B:
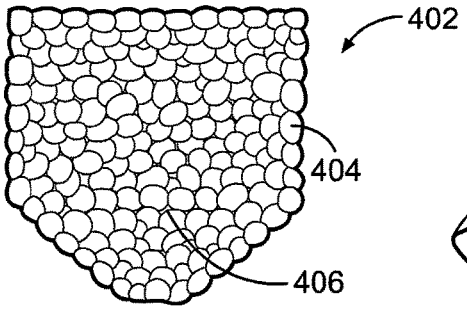
FIG. 4B illustrates a side view of the shaped charge of FIG. 4A.

Referring to FIG. 4A, a shaped charge in accordance with a second illustrative embodiment of the present disclosure is denoted generally with reference numeral 400. The outer case 402 of the shaped charge 400 may comprise two or more predefined elements 404 coupled together. FIG. 4B shows a side view of the shape charge 400 of FIG. 4A. In certain embodiments in accordance with the present disclosure, the predefined elements 404 may be generally spherical pellets. In other embodiments in accordance with the present disclosure, the predefined elements 404 may be wedge-shaped. Any suitable mechanism may be used to couple the predefined elements 404 to form the outer case 402. For instance, in certain embodiments in accordance with the present disclosure, the predefined elements 404 may be coupled by hot isostatic pressing ("HIP"), heat, pressure, bonding agents, brazing, or a combination thereof. In accordance with the illustrative embodiment of FIG. 4A, the predefined elements 404 may be pressed together by HIP. The predefined element 404 may comprise a metal alloy that is operable to deform in the process of forming the outer case 402, or that is operable to adhere to adjacent predefined elements 404 during the HIP operation. In certain embodiments, the outer case 402 of the shaped charge 400 may further comprise an adhesive material or brazing alloy to join the adjacent predefined elements 404.

Figure 4C:
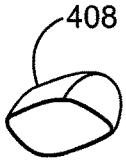
FIG. 4C illustrates a predefined fragment of the shaped charge of FIGS. 4A and 4B.

In certain embodiments in accordance with the present disclosure, the boundaries between the two or more predefined elements 404 are weak points that form the one or more predefined fracture lines 406 of the outer case 402. As would be appreciated by those of ordinary skill in the art having the benefit of this disclosure, upon firing the perforating gun 12, and detonation of explosive material 410 of the shaped charge 400, the explosive material 410 may cause the inner liner 412 to form a jet of particles and high pressure gas that is ejected from the shaped charge 400 at a high velocity. Further, upon detonation of at least one shaped charge 400, the outer case 402 of the detonated shaped charge 400 may break apart into one or more predefined fragments 408, as illustrated in FIG. 4C, defined by the boundaries or predefined fracture lines 406 between the predefined elements 404.

Figure 5A:
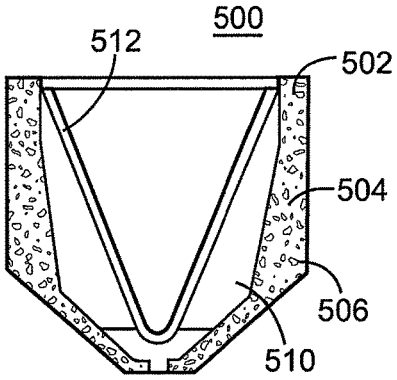
FIG. 5A illustrates a cross-sectional view of a shaped charge, in accordance with a third illustrative embodiment of the present disclosure.
Figure 5B:
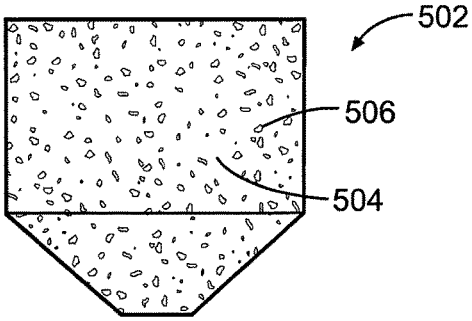
FIG. 5B illustrates a side-view of the shaped charge of FIG. 5A.

Referring to FIG. 5A, a shaped charge in accordance with a third illustrative embodiment of the present disclosure is denoted generally with reference numeral 500. In certain embodiments in accordance with the present disclosure, the outer case 502 of the shaped charge 500 may comprise a composite. FIG. 5B shows a side view of the shape charge 500 of FIG. 5A. In certain illustrative embodiments, the composite may further include a metal matrix 504. The composite may, be molded or shaped depending upon the metal matrix 504 selected, or may be machined or cut from a solid form of a material. As used herein, the term "matrix" refers to a material in which another material is dispersed. The metal matrix 504 may comprise any suitable material operable to couple one or more particles 506 dispersed therein. Upon detonation of the explosive material 510 of the shaped charge 500, the metal matrix 504 may completely break apart, chemically react, or vaporize. Similarly, if the metal matrix 504 is soft and/or low in density, the metal matrix 504 may not pose as great a risk for wellbore debris or gun wall impact as the parties 506 dispersed therein. In certain embodiments, the particles 506 may be any suitable material including, but not limited to ceramics, zinc, tungsten, metal alloys. In other embodiments, the particles 506 may be elongated fibers of glass, carbon, Kevlar, ceramic, or metal alloys. For instance, in certain embodiments, tungsten particles may be included in a zinc matrix. The particles 506 may remain solid within the metal matrix 504. The particles 506 may provide certain stiffness, strength, or density properties that are desirable for the detonation behavior of the outer case 502 of the shaped charge 500.

Figure 5C:
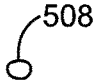
FIG. 5C illustrates a predefined fragment of the shaped charge of FIGS. 5A and 5B.

As would be appreciated by those of ordinary skill in the art having the benefit of this disclosure, upon firing the perforating gun 12, and detonation of explosive material 510 of the shaped charge 500, the explosive material 510 may cause the inner liner 512 to form a jet of particles and high pressure gas that is ejected from the shaped charge 500 at a high velocity. Further, upon detonation of at least one shaped charge 500 in accordance with this exemplary embodiment, the particles 506 may break out of the metal matrix 504, forming one or more predefined fragments 508, as illustrated in FIG. 5C. In certain embodiments, tungsten particles in the zinc matrix may increase the density of the outer case 502, yet minimize the mass of the predefined fragments 508 that may impact an inner wall of the gun body 22 upon detonation of the shaped charge 500. The added density of the outer case 502 may provide inertia for better jet performance while the reduced mass of each predefined fragment 508 may reduce the impact energy on the inner wall of the gun body 22.

In certain embodiments, the one or more predefined fragments 310, 408, 508 may be adapted to be low-debris (i.e., debris of a certain size). The size of debris considered to be "low debris" depends upon the size of the exit holes (not shown) created in the gun body upon detonation. If the debris is larger than the exit holes created and retained inside the gun body 22, then the fragment may be considered to be a low debris fragment because it does not enter the wellbore. Thus, the size of the exit holes (not shown) formed in the gun body 22 sets a size limit for debris that may escape the gun body 22 and enter the wellbore 16. The size of the exit hole (not shown) varies with the size and design of the shaped charges 26 used. In certain embodiments in accordance with the present disclosure, a typical maximum size of debris may be 0.3-0.5 inch diameter. In certain embodiments in accordance with the present disclosure, the one or more predefined fragments 310, 408, 508 may be larger than the exit holes (not shown) of the gun body 22. Consequently, the predefined fragments 310, 408, 508 may be retained within the gun body 22.

In certain embodiment in accordance with the present disclosure, the one or more predefined fragments 310, 408, 508 are adapted to minimize impact forces on an inner wall of the gun body 22, as compared to prior art shaped charges (not shown), thereby reducing the risk of perforating gun failure. The predefined fragments 310, 408, 508 may be adapted to minimize impact forces on an inner wall of the gun body 22. Specifically, the outer case 32 of a configuration in accordance with the present disclosure as discussed in conjunction with the illustrative embodiments of FIGS. 3-5 may be adapted to break apart into a sufficient quantity of predefined fragments such that the size of the predefined fragments 310, 408, 508 is small enough to minimize the impact forces on the inner wall of the gun body 22.

In certain embodiments, the predefined fragments 310, 408, 508 may be adapted to improve upon the surface-area to volume ratio of prior art shaped charges (not shown). For example, if the outer case 302, 402, 502 comprises a reactive material, such as zinc which is believed to react and/or vaporize, then smaller predefined fragments 310, 408, 508 will react more quickly than larger ones. If a fast reaction results in too high of a pressure rise, then larger predefined fragments 310, 408, 508 may be advantageous for slowing down the rate of reaction, and thus reducing the peak pressure that results.

As would be appreciated by those of ordinary skill in the art, having the benefit of the present disclosure, the configurations described in conjunction with FIGS. 3-5 may be combined in a particular shaped charge. Specifically, a shaped charge may be designed that includes the matrix material of FIG. 5A as well as the grooves 308 of FIG. 3A and/or the predefined elements 404 of FIG. 4A.

Moreover, as would be appreciated by those of ordinary skill in the art having the benefit of this disclosure, a shaped charge 300, 400, 500 has an explosive load determined by the amount of explosive material 306, 410, 510 retained between the outer case 302, 402, 502 and the inner liner 304, 412, 512 of the shaped charge 300, 400, 500. Larger explosive loads per shaped charge may be possible in larger diameter perforating gun systems that are run in correspondingly larger sized tubular strings. Smaller diameter perforating guns, selected to fit within wellbore tubular string size constraints, are limited to relatively smaller shaped charges, and thus smaller explosive load.

In certain embodiments, a specific material composition of the outer case 302, 402, 502, and orientation of the predefined fracture lines 308, 406, and the size of the predefined fragments 310, 408, 508 may be selected based on the explosive load of the shaped charge 300, 400, 500 and the size of the exit holes (not shown) in the gun body 22. For instance, in certain embodiments in accordance with the present disclosure, the specific material composition of the outer case 302, 402, 502 may include a solid metal with one or more grooves 308, as shown in FIG. 3A. In certain embodiments, the orientation of the predefined fracture lines 308, 406 may include machined or molded grooves 308 forming stress concentration lines, as shown in FIG. 3B, or boundary lines between predefined elements 404, as shown in FIG. 4B. For instance, a shaped charge 300, 400, 500 with a 49 gram explosive load may have a different specific material composition and fracture line orientation than a shaped charge 300, 400, 500 with a 20 gram explosive load.

Accordingly, the specific material composition of the outer case 302, 402, 502 and the orientation of the predefined fracture lines 308, 406 may be tuned depending on the explosive load of the shaped charge.

Shaped charges may designed for a range of performance objectives and wellbore considerations. For example, "deep penetrating" shaped charges may be designed to maximize penetration depth in the formation while "big hole" shaped charges may be designed to maximize the perforation diameter. In addition, shaped charge selection may depend on shot density and shot phasing, which also vary in perforating gun systems. The term shot density, as used herein, refers to the number of shots per foot. As would be appreciated by one of ordinary skill in the art, shot density may range from less than 1 shot per foot (e.g., 1 shot every 10 feet) to approximately 24 shots per foot depending upon the size of the charges and the size of the carrier gun. The term shot phasing, as used herein, refers to the direction to which the shots are fired, usually described in the form of "degrees." As would be appreciated by one of ordinary skill in the art, shot phasing may be a linear pattern of a single 0 degree phase to a 0/180 degree phase, or any of a wide range of other options. In addition, as would be appreciated by one of ordinary skill in the art, a number of patterns may be used to describe shot phasing. Examples of patterns include, but are not limited to, star pattern, whisker pattern, and 3-per plane pattern, spiral pattern, helix pattern, double helix pattern, twisted pattern, and other specific fixed angle patterns. The present invention offers a wide array of design alternatives to better maximize shaped charge performance and debris objectives for any shaped charge type or application. As would be appreciated by those of ordinary skill in the art having the benefit of this disclosure, for any given shaped charge size and application, the shaped charge design may be tuned to achieve a desired fragmentation pattern.

Accordingly, an apparatus and method for controlling charge case fragmentation is provided that reduces the risk of gun failures. Using shaped charges in accordance with the present disclosure results in desirable charge performance with low-debris fragmentation, elimination of the rapid pressure rise often caused by prior art zinc charges, and reduced downhole problems.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. For example, many of the features could be moved to different locations on respective parts without departing from the spirit of the invention. Furthermore, no limitations are intended to be limited to the details of construction or design herein shown, other than as described in the claims below. It is therefore evident that the particular illustrative embodiments disclosed above may be altered or modified and all such variations are considered within the scope and spirit of the present invention. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. A perforation apparatus comprising:

a perforating gun comprising a gun body and a charge carrier;

a shaped charge disposed within the charge carrier, wherein the shaped charge comprises:

an outer case;

an inner liner;

an explosive material retained between the outer case and the inner liner, wherein the outer case comprises one or more predefined fracture lines and two or more predefined elements, and wherein the two or more predefined elements are coupled to one another; and an explosive load, wherein a material composition of the outer case, an orientation of the one or more predefined fracture lines, and a size of the two or more predefined elements is based on the explosive load and a size of one or more exit holes to be formed in the gun body.

2. The perforation apparatus of claim 1, wherein the one or more predefined fracture lines are the boundaries between the two or more predefined elements.

3. The perforation apparatus of claim 1, wherein the outer case is formed by a process selected from a group consisting of machining, molding, hot isostatic pressing, brazing, encapsulating, compositing, bonding, forging, sintering and laser depositing.

4. The perforation apparatus of claim 1, wherein the outer case comprises at least one of an aluminum alloy, a steel alloy, a copper alloy, a zinc alloy, a nickel alloy, a tungsten alloy, a ceramic, and a combination thereof.

5. The perforation apparatus of claim 1, wherein the outer case further comprises one or more grooves, and wherein the one or more predefined fracture lines are stress concentrations formed by the one or more grooves.

6. The perforation apparatus of claim 5, wherein the one or more grooves are machined grooves, wherein the machined grooves are formed by a material removal process.

7. The perforation apparatus of claim 6, wherein the material removal process is selected from a group consisting of cutting, chemically etching, laser ablating, abrasive jet cutting and eroding.

8. The perforation apparatus of claim 5, wherein the one or more grooves are molded grooves, wherein the molded grooves are formed by a material forming process, and wherein the material forming process is selected from a group consisting of molding, forming, pressing and forging.

9. The perforation apparatus of claim 1, wherein the outer case comprises a composite.

10. The perforation apparatus of claim 9, wherein the composite further comprises a metal matrix.

11. The perforation apparatus of claim 10, wherein the metal matrix comprises at least one of zinc, tungsten, metal alloys, or a combination thereof.

12. The perforation apparatus of claim 10, wherein the metal matrix comprises elongated fibers of at least one of glass, carbon, Kevlar, or a combination thereof.

13. The perforation apparatus of claim 9, wherein the composite further comprises a ceramic matrix.

14. A method for forming a perforation comprising the steps of:

positioning a perforating gun comprising a gun body and a charge carrier at a desired location in the formation;

disposing one or more shaped charges within the charge carrier, wherein the one or more shaped charges comprise:

an outer case;

an inner liner;

an explosive material retained between the outer case and the inner liner, wherein the outer case comprises one or more predefined fracture lines; and an explosive load;

detonating at least one shaped charge, wherein detonating the at least one shaped charge forms one or more predefined fragments and one or more exit holes in the gun body, wherein the one or more predefined fragments are coupled to one another and are larger than the one or more exit holes; and retaining the one or more predefined fragments in the gun body, wherein a material composition of the outer case, an orientation of the one or more predefined fracture lines, and a size of the one or more predefined fragments are based on the explosive load of the shaped charge and a size of the exit holes to be formed in the gun body.

15. The method of claim 14, wherein detonating the at least one shaped charge forms one or more perforations in the formation.

16. The method of claim 15, wherein the one or more predefined fragments are defined by the predefined fracture lines of the shaped charge.

17. The method of claim 15, wherein impact forces on an inner wall of the gun body are minimized in part due to the size of the one or more predefined fragments.

18. The method of claim 15, wherein a pressure rise in the perforating gun is controlled in part by a size of the one or more predefined fragments.

19. A method for forming a perforation comprising the steps of:

positioning a perforating gun comprising a gun body and a charge carrier at a desired location in the formation;

disposing one or more shaped charges within the charge carrier, wherein the one or more shaped charges comprise:

an outer case;

an inner liner;

an explosive material retained between the outer case and the inner liner, wherein the outer case comprises one or more predefined fracture lines; and an explosive load;

detonating at least one shaped charge, wherein detonating the at least one shaped charge forms one or more perforations in the formation, one or more predefined fragments, and one or more exit holes in the gun body; and selecting a material composition of the outer case, an orientation of the predefined fracture lines, and a size of the predefined fragments based on the explosive load of the shaped charge and a size of the exit holes in the gun body.

* * * * *